US007238901B2

(12) United States Patent
Kim et al.

(10) Patent No.: US 7,238,901 B2
(45) Date of Patent: Jul. 3, 2007

(54) TAMPER RESISTANT PIN ENTRY APPARATUS

(75) Inventors: Bo Soon Kim, Kyunggi-do (KR); Hyun Soo Jang, Kyunggi-do (KR); Seung Chan Lee, Daegu-si (KR)

(73) Assignee: Nautilus Hyosung Inc., Seoul (KR)

( * ) Notice: Subject to any disclaimer, the term of this patent is extended or adjusted under 35 U.S.C. 154(b) by 102 days.

(21) Appl. No.: 11/123,191

(22) Filed: May 6, 2005

(65) Prior Publication Data

US 2006/0102458 A1 May 18, 2006

(30) Foreign Application Priority Data

Nov. 12, 2004 (KR) ..... 10-2004-0092464

(51) Int. Cl.
*H01H 3/16* (2006.01)

(52) U.S. Cl. ..... 200/61.8; 200/5 A; 200/5 R; 200/520; 200/341

(58) Field of Classification Search ..... 200/61.8
See application file for complete search history.

(56) References Cited

U.S. PATENT DOCUMENTS 5,654,701 A * 8/1997 Liao et al. ..... 341/22
6,065,679 A * 5/2000 Levie et al. ..... 235/462.47
6,512,454 B2 1/2003 Miglioli et al.
6,838,619 B1 * 1/2005 Soyfertis ..... 174/50
6,941,274 B1 * 9/2005 Ramachandran et al. ..... 705/26
7,045,730 B2 * 5/2006 Hollar et al. ..... 200/293

* cited by examiner

*Primary Examiner*—Elvin Enad
*Assistant Examiner*—Lheiren Mae A. Anglo
(74) *Attorney, Agent, or Firm*—Fish & Richardson P.C.

(57) ABSTRACT

Disclosed is a tamper resistant PIN entry apparatus for input of a key and for encryption of a password in a cash transaction machine. The PIN entry apparatus supplies the electric power to a memory of an electric circuit section, in such a manner that a first rod and a second rod of a rear case connect contacts of a key scan board, wherein the first rod is protruded on the rear of a key module including a button provided substantially on the front of the key module and the second rod of the rear case is coupled with the rear of the key module. At this time, in case that the rear case is removed from the key module or damaged, thereby changing the location of any one of the first and the second rods at the contact, the electric circuit section detects the event and destroys the memory itself physically. Otherwise, the electric circuit section makes information stored in the memory physically or softwarely unreadable, thereby preventing the leakage of the information.

16 Claims, 8 Drawing Sheets

FIG. 1
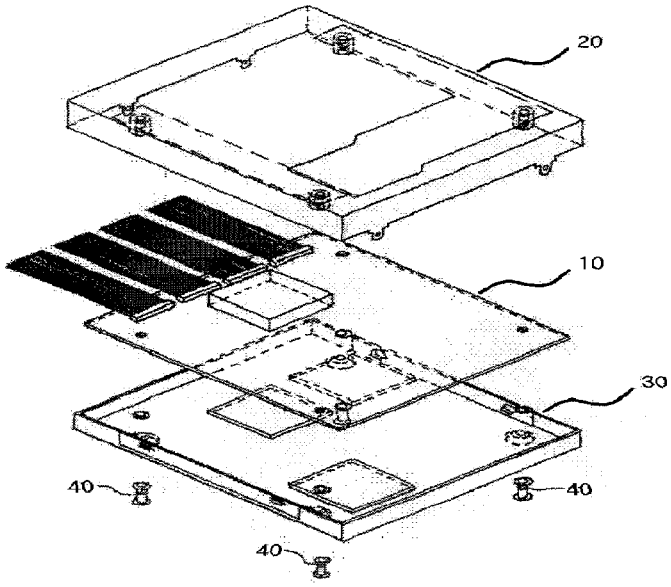
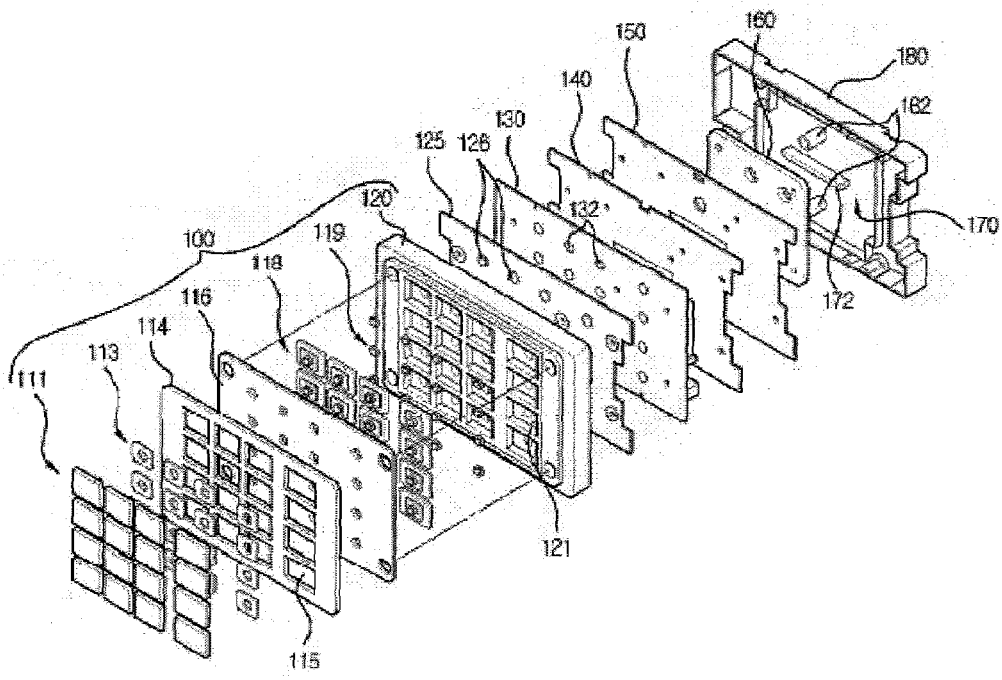
FIG. 2

TAMPER RESISTANT PIN ENTRY APPARATUS

CROSS REFERENCE TO RELATED APPLICATION

This application claims priority under 35 USC § 119 to Korean Patent Application No. 2004-92464 filed on Nov. 12, 2004, the contents of which are incorporated herein by reference in its entireties.

BACKGROUND OF THE INVENTION

1. Field of the Invention

The present invention relates to an apparatus for entering a Personal Identification Number (hereinafter, PIN) in a cash transaction machine. More particularly, the present invention relates to a PIN entry apparatus for protecting a PIN and encrypting a user's valuable information in a cash transaction machine (terminal), and relates to a tamper resistant PIN entry apparatus in which the apparatus, in case that the PIN entry apparatus is disassembled to hack into a password, detects the event, makes the password or key data unreadable, and in case that a key pad is to be partially incised, prevents hacking of the password by disabling the incision.

2. Description of the Related Art

Generally, a device such as a financial terminal that prevents illegal access of another person for personal purpose, grants a password per user so as to authenticate financial transactions. In addition, the device like above lets the user input the password before performing financial transactions, and allows the next step to be performed only when the input password is confirmed to be identical to the pre-registered password.

Like above, a financial terminal requires the maximum security, and an encryptor for encrypting inputted data is coupled with a key pad for input of a password. As for the encryptor like above, there is being widely used an encryption PIN pad module that adopts DES (Data Encryption Standard) algorithm.

The DES PIN pad module is a module for processing encryption with respect to a user's password or a key. Therefore, the DES PIN pad module comprises number buttons for inputting a password, a plurality of selection buttons for performing all kinds of functions, and SRAM storing an encryption key. At this time, the SRAM is included in an electric circuit embedded inside the device, so as to disable the external random manipulation. On the other hand, the number buttons, the selection buttons, and the like are exposed on a position where a user can manipulate easily.

However, in case that a user with unjust intentions disassembles the DES PIN pad module embedded in a financial terminal and connects a separate hacking equipment to a key input unit, there is a problem that passwords might remain in a memory might be leaked.

The prior art to solve the aforementioned problem is the U.S. Pat. No. 6,512,454, and said United States Patent relates to technology which destroys information stored in a memory so as to maintain information stored in an electronic device, in case that a third person tries to access thereto.

For this, said United States Patent comprises an enclosure for protecting the electronic device and an electrical assembly adopting the enclosure.

FIG. 1 is a perspective view illustrating the conventional PIN pad module.

Briefly describing a technical configuration referred to said United States Patent, as shown in FIG. 1, an electronic device 10 is enclosed by first and second covers 20 and 30, and a fixing component 40 (e.g., a screw) passes through the first cover 20, so as to bind the covers 20 and 30 to each other, and passes through the electronic device 10, so as to form a part of an electric circuit.

In a normal state, fixing components 40 according to said United States Patent enable an electric current to pass to a part of circuit stably. However, in a state where any one of fixing components 40 is partially removed by an intruder or the like, the electric current circulating the fixing components 40 is cut off and a detector detects the event.

That is, although said United States Patent relates to technology for detecting external intrusion with respect to the electronic device 10, it is apparent that a detecting method is mainly concentrated on the fixing components 40 such as screws or the like. At this time, the fixing component 40 should form a part of circuit, not a simple fixing means, and separation thereof 40 or partial removal thereof 40 is required to detect an intruder's intrusion. The detector should detect the event directly through control of relevant circuits.

However, according to the conventional technology for protecting the electronic device, such as said United States Patent, in case that the intruder cuts off any one of the first and the second covers 20 and 30 of the electronic device 10, without touching the fixing component 40, thereby maintaining an electric current in a normal state, the electronic device 10 does not detect the external intrusion. Thus, there is a problem that information stored in the memory of the electronic device 10 might be leaked by hacking equipment.

Furthermore, only in case that the fixing component 40 such as a screw is completely removed from the electronic device 10, the flow of electric current is blocked and the detector detects the event. Therefore, in case that an intruder unscrews and cuts off the fixing component 40 by predetermined length, so as to maintain the flow of electric current of the electronic device 10 as it is, the first and the second covers 20 and 30 that enclose the electronic device 10 are opened to each other, and the electronic device 10 enclosed thereby 20 and 30 is completely exposed. Thus, there is a problem that the intruder may obtain useful information from the memory of the electron device 10 by using hacking equipments.

SUMMARY OF THE INVENTION

The present invention enables to protect a PIN entry apparatus having important information in a cash transaction machine or ATM (Automated Teller Machine). That is, in case that an intruder accesses a memory by disassembling or cutting the PIN pad module while maintaining the fixing structure thereof, an apparatus of the present invention enable to protect the PIN pad module from hacking of passwords. For one example, an apparatus of the present invention may comprise protecting functions of deleting inside data of SRAM, and of losing inside data thereof by cutting off the electronic power supplied to the SRAM, and the SRAM is a memory storing an encryption key and the like.

An apparatus for protecting a PIN pad module according to the present invention comprises a key module, a key scan board, a rear case and an electric circuit section. The key module includes a button for key input provided substantially on the front of the key module and a first rod formed substantially on the rear of the key module. The key scan board includes a first contact for the button, a second contact for the first rod and a third contact, wherein the first and the second contacts are formed substantially on the front of the key scan board and the third contact is formed substantially on the rear of the key scan board. The rear case is coupled with the key module and includes the second rod for the third contact. The electric circuit section might make stored information unreadable in accordance with a change of an electric current or voltage at the second contact or the third contact, the change caused by reduction or absence of pressing force by the first rod or the second rod.

At this time, that the electric circuit section makes stored information unreadable includes both physical protection and software protection which prevents leakage of important information in all kinds of information storage media which input/output information at any time, such as for example a RAM, a flash memory, an optical disk, a magnetic disk, etc.

For example, the electric circuit section may include an analog control module that delivers high voltage or a lot of electric current to a storage medium, so as to destroy the storage medium storing information. In addition, the electric circuit section may produce a control module easily by using a microcontroller, and damage the storage medium by enabling the control module to control a power generator that generates the voltage or electric current. In case that the storage medium is a random access memory that maintains information only when electric power is supplied, such as SRAM, the electric circuit section may delete information by cutting off electricity.

Furthermore, the electric circuit section may include a control module having a program in which orders of remembering information included in the storage medium may be disordered or partially lost and information stored in the storage medium may be replaced for dummy information or completely deleted.

Preferably, the electric circuit section may include a memory such as SRAM storing information. When the electric circuit section detects the change of voltage or electric current with respect to any one of the second and the third contacts, the electric circuit section may prevent leakage of information by making the stored information unreadable, just like cutting the power supply thereto.

Furthermore, a metal plate is mounted adjacent to the key module or the rear case to physically protect the key scan board against a tampering attempt.

The first rod or the second rod may include a tube portion and a rubber member, wherein the tube portion is protruded on the key module or the rear case toward the second contact or the third contact, and the rubber member is positioned at the end of the tube portion to elastically press the second or the third contact, respectively.

A circuit connector may be formed on the electric circuit section and a board connector may be formed on the key scan board in accordance with the circuit connector, such that the board connector may be electrically connected to the circuit connector to transmit the states of connection at the first, the second and the third contacts to the electric circuit.

Here, the board connector and the circuit connector may be positioned between the key scan board and the rear case, so the connecting portion of the connectors may be easily exposed to an intruder when separating the rear case from the key module. Also, the circuit and the board connector may be electrically connected using a plurality of metal pins and pin holes having a terminal in general and the intruder may use a conduction liquid to electrically connect the metal pin and the terminal of the pin hole. In order to protect the apparatus from a tamper attempt using a conduction liquid, ink, etc., the metal pins and the pin holes may be arranged perpendicularly across the third contacts.

For example, in case that two of the third contacts are positioned vertically, the metal pins and the pin holes of the connectors are arranged horizontally between the third contacts. At this time, the first reason why the board connector is positioned substantially on a vertical line passing between the third contacts is to prevent general accesses to the third contact and prevent the third contact from being applied by electric conduction liquid (electric conduction ink). Thus, in case that the rear case is to be removed from the key module, the electric circuit section detects the event immediately. The second reason is to hide the connecting portion of the circuit connector and the board connector with the second rod, so that the intruder may have many difficulties to flow the conduction liquid for cheating connections.

Furthermore, at least one of the second and the third contacts may be positioned adjacent to a screw hole for a screw. When the screw is unscrewed or removed, the states of connection of the first and the second rods for the second and the third contacts change. The electric circuit section may detect the change of the voltage or electric current at one or more contacts of the second and the third contacts, and may make the memory unreadable, e.g. by destroying or erasing the stored information.

Moreover, the screw hole may be formed at the center portion of the key scan board, and the second contact may be positioned adjacent to the screw hole on the key scan board. At this time, a couple of screw holes are provided and the second contact is positioned therebetween. In case that the screw hole is unscrewed, the first rod for the second contact is separated. Thus, the electric circuit section may detect the event easily.

Preferably, the second contact or the third contact may include three terminals, such as a first terminal, a second terminal and third terminal. The first terminal and the second terminal may be electrically connected by the adjacent rod and the third terminal may be formed closely adjacent to the first and the second terminal to form a part of the electric circuit section. The electric circuit section may make the stored information unreadable when the first and the second terminal are electrically separated because of removing or separating the rod. Also, although an intruder may try to electrically connect the first and the second terminals with conduction liquid or ink, the electric circuit section may detect connection between the first and the third terminals or between the second and the third terminals to make the stored information unreadable.

Furthermore, the second and the third contacts may be formed using piezo electric elements to measure the pressing force. Therefore, in case that the pressing force by any one of the first and second rods changes and the electric voltage or current changes in accordance with the change of the pressing force, the electric circuit section may detect the event and make the stored information unreadable.

Furthermore, a front membrane may be interposed between the key module and the key scan board. The front membrane includes a first switching portion for electrically connecting or cutting off the first contact according to the button of the key module and a second switching portion for electrically connecting or cutting off the second contact according to the first rod.

A rear membrane may be interposed between the key scan board and the rear case, wherein the rear membrane includes a third switching portion for electrically connecting or cutting off the third contact according to the second rod.

The switching portion of the first or the second membrane is similar to a general membrane switch formed on a button in a mobile phone, and includes an elastic dome for elastically receiving the pressing force. The lower surface of the elastic dome is formed using an electric conductor such as a carbon and connects the terminal of contacts formed on the key scan board.

In addition, a back bracket is interposed between the key scan board and the electric circuit section to substantially support the key scan board and the electric circuit section for prevent them from being bent. At this time, the back bracket may be formed using a plurality of metal plates and the metal plates may have different thickness respectively. The back bracket is interposed between the key scan board and the electric circuit section, with filling the gap formed therebetween.

The key module further comprises a protection rubber attached on the rear of the button for water-proofing; a front bracket positioned substantially at the front of the button, having a button hole regularly arranged in the front bracket; a protection pad positioned substantially at the rear of the front bracket, wherein the protection rubber is stuck to the protection pad for water-proofing; a transmitting member positioned substantially at the rear of the protection pad, for transmitting the pressing force given to the button; a switching member positioned substantially at the rear of the transmitting member, for transmitting the pressing force given to the transmitting member; and a bezel base including a groove formed substantially on the front of the bezel base for receiving the transmitting member, a hole formed at the groove for passing the switching member and the first rod protruded backward at the rear of the bezel base to press the second contact.

At this time, in case that at least one of the first rod and the second rod for second and third switching portions of the membrane is removed from the bezel base of the key module and the pressing force or location thereof changes, and the voltage or electric current changes at least one of a plurality of second and third contacts for the second switching portion and the third switching portion, the electric circuit section detects the event and makes the stored information unreadable.

In addition, the protection pad is positioned substantially at the rear end of the button and prevents water from penetrating into the front bracket, thereby, forming the waterproof structure together with the protection rubber.

Moreover, the bezel base is formed by injecting plastic into an injection mold, and a plurality of first rods is positioned on the rear of the bezel base. One of the first rods is positioned on one side at the center of the bezel base and the other is positioned on the other side at the center thereof, spaced apart by a predetermined interval At this time, the first rods are positioned on each of sides at the center and the bezel base is spaced apart from the rear case. Therefore, the location of the first rod changes and the voltage or the electric current of the second contact for the first rod also changes. The electric circuit selection detects the event and makes information stored in the memory unreadable immediately.

Furthermore, the key module may comprise a bezel base positioned at the front of the rubber pad, including a hole for exposing the button and a rubber pad including the button protruded forward substantially at the front of the rubber pad and the first rod protruded backward substantially at the rear of the rubber pad.

BRIEF DESCRIPTION OF THE DRAWINGS

The present invention will become more apparent to those of ordinary skill in the art be describing, in detail, exemplary embodiments thereof, with reference to the attached drawings, wherein like elements are represented by like reference numerals, which are given by way of illustration only and thus do not limit the exemplary embodiments of the present invention.

FIG. 1 is a perspective view illustrating the conventional PIN pad module.

FIG. 2 is a perspective view illustrating an apparatus for protecting a PIN pad module according to one embodiment of the present invention.

DESCRIPTION OF THE INVENTION

Figure 3:
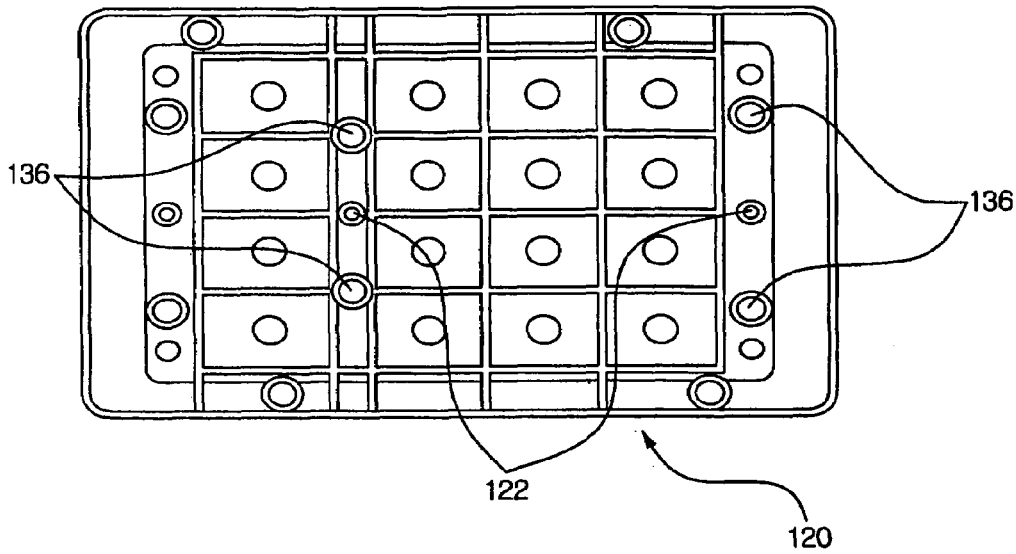
FIG. 3 is a plan view illustrating the rear of a bezel base according to one embodiment of the present invention.

Hereinafter, exemplary embodiments of the present invention will be more fully described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. Like reference numerals refer to similar or identical elements throughout.

Figure 4:
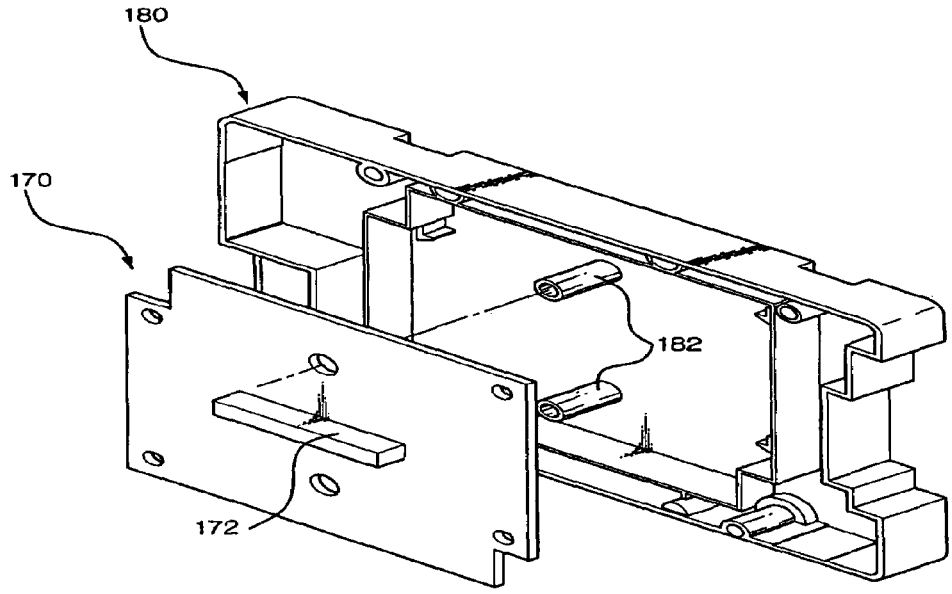
FIG. 4 is a partial perspective view illustrating an apparatus for protecting a PIN pad module according to one embodiment of the present invention.
Figure 5:
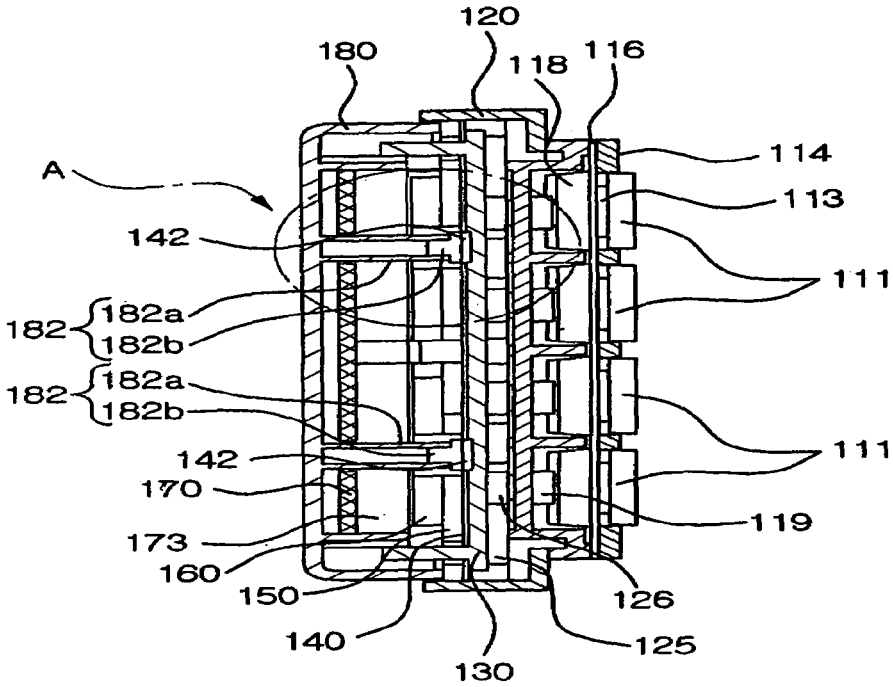
FIG. 5 is a sectional view illustrating an apparatus for protecting a PIN pad module according to one embodiment of the present invention.
Figure 6:
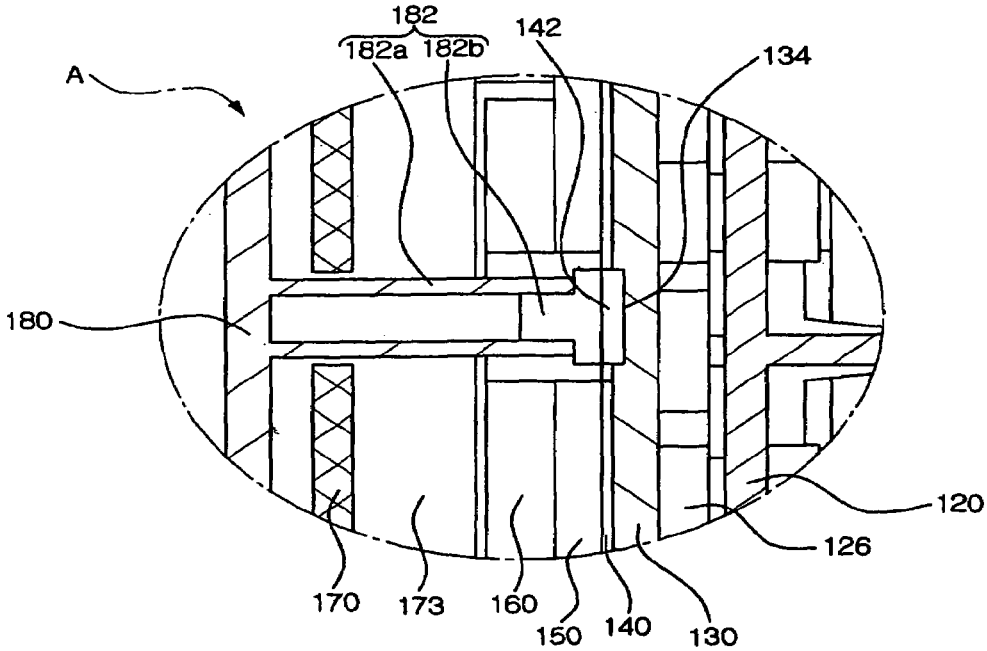
FIG. 6 is a partially enlarged view illustrating a second rod and a third contact of FIG. 5.
Figure 7:
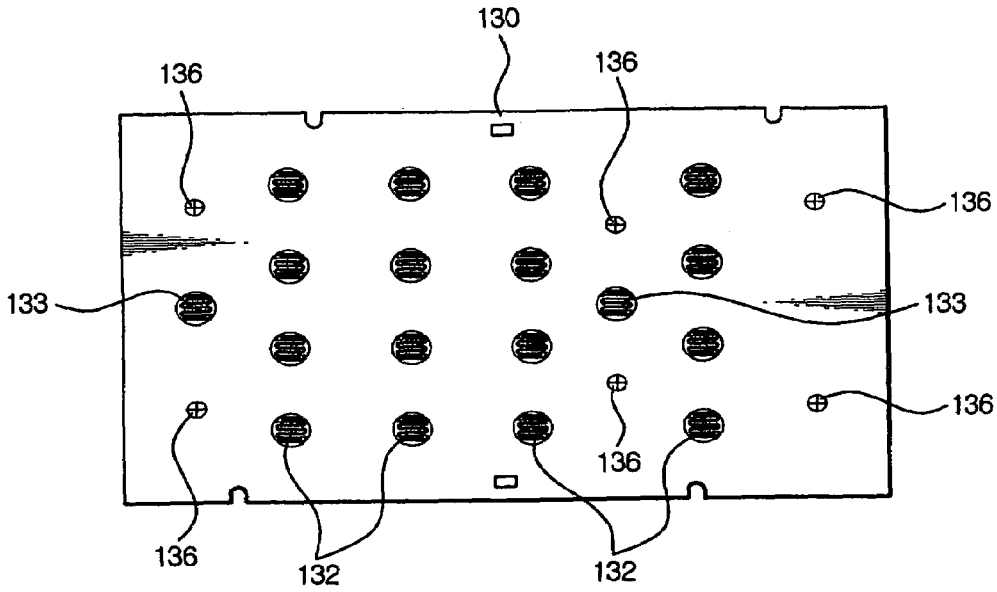
FIG. 7 is a plan view illustrating the upper surface of a key scan board according to one embodiment of the present invention.
Figure 8:
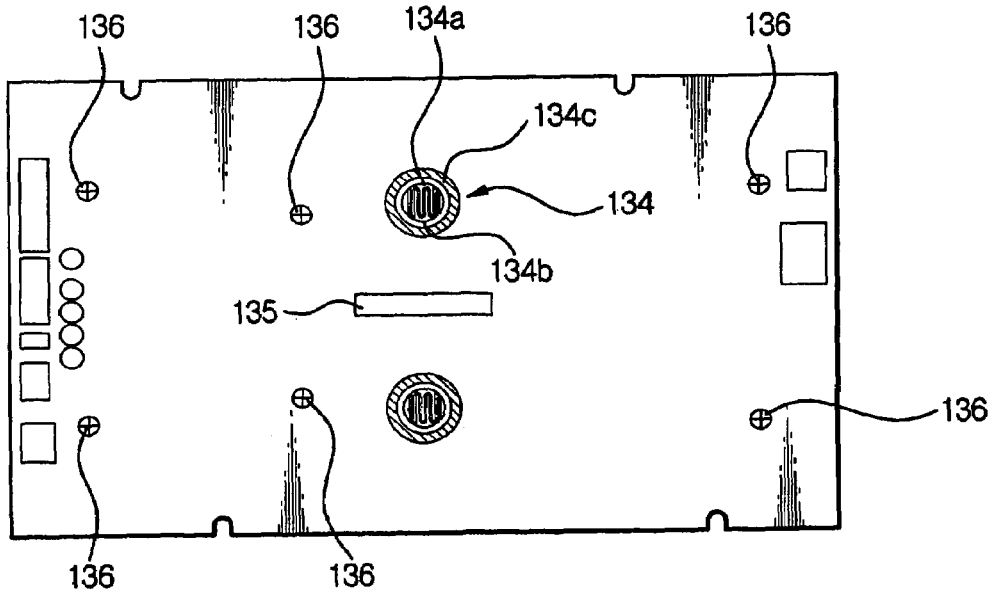
FIG. 8 is a bottom view illustrating the lower surface of a key scan board according to one embodiment of the present invention.
Figure 9:
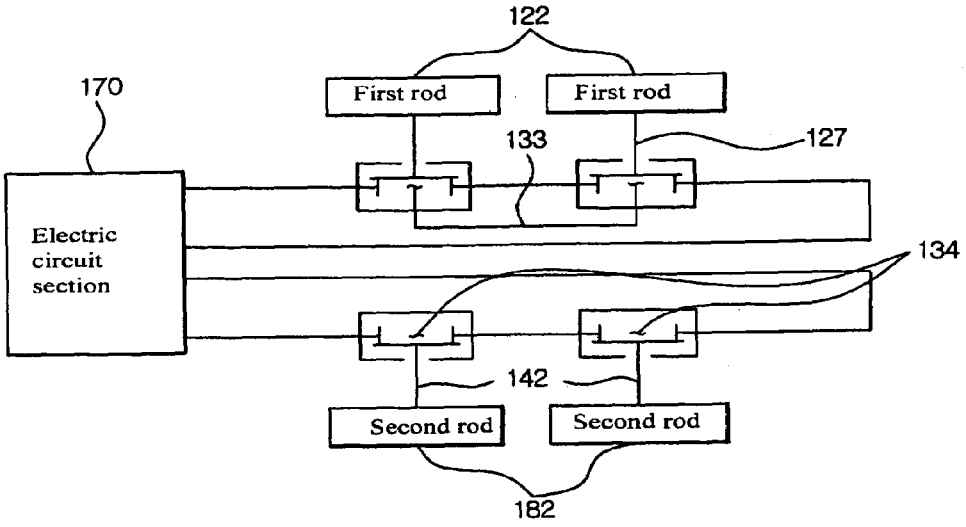
FIG. 9 is a schematic view illustrating a process of protecting a PIN pad module according to one embodiment of the present invention.

FIG. 2 is a perspective view illustrating an apparatus for protecting a PIN pad module according to one embodiment of the present invention; FIG. 3 is a plan view illustrating the rear of a bezel base according to one embodiment of the present invention; FIG. 4 is a partial perspective view illustrating an apparatus for protecting a PIN pad module according to one embodiment of the present invention; FIG. 5 is a sectional view illustrating an apparatus for protecting a PIN pad module according to one embodiment of the present invention; FIG. 6 is a partially enlarged view of FIG. 5; FIG. 7 is a view illustrating the upper surface of a key scan board according to one embodiment of the present invention; FIG. 8 is a view illustrating the lower surface of a key scan board according to one embodiment of the present invention; and FIG. 9 is a view illustrating a process of protecting a PIN pad module according to one embodiment of the present invention.

As illustrated, in order to achieve the above object, an apparatus for protecting a PIN pad module according to one embodiment of the present invention comprises a key module 100 including pluralities of buttons 111 and a bezel base 120 wherein the buttons 111 are provided substantially on the front of the key module 100 and pluralities of protruded first rods 122 are formed on the rear of the key module 100; a first switching portion 126 for the button 111 of the key module 100 and a second switching point 127 for the first rod 122 of the bezel base 120; and a front membrane 125 for transmitting the pressing force of the button 111 and the first rod 122 through the first switching portion 126 and the second switching portion 127.

Furthermore, the button 111 provided substantially on the front of the key module 100 is inserted into a front bracket 114, which has a button hole 115, to be close to a protection rubber 113, the rear of the button 111 passes through the rear of the front bracket 114 tightly, and the protection pad 116 is provided on the rear of the protection rubber 113, wherein the front bracket 114 is formed into a lattice. At this time, the protection rubber 113 prevents water from penetrating through the space between the button 111 and the front bracket 114, and the protection pad 116 prevents water from penetrating into the bezel base 120.

Furthermore, a transmitting member 118 is positioned substantially at the rear of the protection pad 116 and at the front of the bezel base 120, for transmitting the pressing force. A switching member 119 is positioned substantially at the rear of the transmitting member 118, for transmitting the pressing force to the first switching portion 126 of the front membrane 125 through the bezel base 120.

At this time, the button 111 and the front bracket 114 constituting the outer surface of the key module 100 are formed using metal plates, and form a protection wall against the external intrusion. Therefore, components provided inside of the key module may be protected.

Moreover, the bezel base 120 is formed by injecting plastic into an injection module, and one of pluralities of first rods 122 formed on the rear of the bezel base 120 is positioned on one side at the center of the bezel base 120 and another is positioned on the other side at the center thereof 120, spaced apart by predetermined interval.

At this time, the bezel base 120, which includes a groove 121 formed substantially on the front of the bezel base 120, is positioned at the rear of the transmitting member 118, and the rear of the button 111 passes through the protection pad 116, thereby pressing a groove 124 formed on the front of the transmitting member 118, and then passes through a hole formed on the bezel base 120, and coupled with the switching member 119, thereby pressing the first switching portion 126 of the front membrane 125.

Furthermore, a key scan board 130 is positioned at the rear of the front membrane 125, and pluralities of first contacts 132 for connecting the first switching portion 126 and pluralities of second contacts 133 for connecting the second switching portion 127 are positioned on the front of the key scan board 130. And pluralities of third contacts 134 are further positioned on the rear of the key scan board 130.

At this time, the first and the second switching portions 126 and 127 of the front membrane 125 are formed using a elastic dome, for elastically receiving the pressing force. An electric conductor such as a carbon board is applied on the lower surface of the elastic dome, and electrically connects the first and the second contacts 132 and 133 positioned on the key scan board 130.

Furthermore, a plurality of second contacts 133 positioned on the front of the key scan board 130 are provided adjacent to a screw hole 136 for a screw for coupling the key module 100 and the rear case 180. When the screw is removed, the pressing force of the first rod 122 for the second contact 133, or the location thereof changes.

More particularly, a pair of screw holes 136 for a screw for coupling the key module 100 and the rear case 180 is formed on a vertical line passing the center portion. The second contact 133 is positioned between the screw holes 136. Thus, in case that the screw is removed, the location or pressing force of the first rod 122 for the second contact 133 changes. The electric circuit section 170 detects the change of the voltage or electric current of the second contact 133 and makes information stored in the memory unreadable immediately.

Furthermore, a rear membrane 140 including a third switching portion 142 for connecting the third contact 134 is positioned at the rear of the key scan board 130. An electric circuit section 170 including a memory is positioned at the rear of the rear membrane 140, for performing logic calculation, wherein the memory first receives a value in accordance with connection of contacts of the key scan board 130 and later stores the same. The rear case 180 is positioned at the rear of the electric circuit section 170, and the rear case 180 includes a second rod 182 for the third switching portion 142 included in the rear membrane 140 and is coupled with the bezel base 120 of the key module 100.

Moreover, third contacts 134 positioned on the rear of the key scan board 130 are formed of a pair and positioned on a vertical line passing the center portion. The arrangement of the third contacts 134 like above is to detect that the rear case 180 is removed from the bezel base 120 with the minimum contacts. Accordingly, in case that the rear of the rear case 180 moves away from the rear of the bezel base 120, even a little, the pressing force of the second rod 182 for the third switching portion 142 of the rear membrane changes and the electric current or the voltage changes at the third contact 134 connected to the third switching portion 142 of the rear membrane 140.

Furthermore, a circuit connector 172 of the electric circuit section 170 is provided on a vertical line passing through the third contacts 134 and a board connector 135, so that the board connector 135, for transmitting the states of connections at contacts of the key scan board 130, passes through the third contacts 134. The arrangement of the board connector 135 like above is to prevent the board connector 135 from getting access to the third contacts 134 and prevent a hacker from applying electric conduction liquid (electric conduction ink) to the third contact to make it as same as the first state of connection thereof 134. In case that the hacker attempts to put electric conduction liquid into the terminal of the circuit connector 172 in a state where the circuit connector 172 is coupled with the board connector 135, the arrangement of the board connector 135 like above is to prevent an instrument including electric conduction liquid from getting access to the circuit connector 172 by the second rod 182 for the third contact 134.

In addition, the third contact 134 includes a first terminal 134*a* and a second terminal 134*b*, which are electrically connected by the second rod 182, and the third contact 134 further includes a third terminal 134*c* which is formed closely adjacent to the first terminal 134*a* and the second terminal 134*b*, and the electric circuit section 170 makes the stored information unreadable in accordance with the connection between the second and the third terminals 134*a* and 134*b*. Furthermore, although it is not illustrated, the second contact 133 also includes a first terminal and a second terminal which are electrically connected by the first rod 122, just like the third contact 134, and may include a third terminal adjacent to the first terminal or the second terminal.

Meanwhile, the second rod 182 of the rear case 180 is formed to be protruded in the opposite direction from the first rod 122, with the similar structure, and includes a tube portion 182*a* and a rubber member 182*b* for the third switching portion 142. At this time, the second rods 182 are formed of a pair to correspond to the third contacts 134 and respectively positioned on the upper portion and the lower portion at the center portion of the rear case 180.

Furthermore, a first back bracket 150 is positioned at the rear of the rear membrane 140 to support the rear membrane 140 and the key scan board 130. A second bracket 160 is formed inside the rear case 180 for the electric circuit section 170, and positioned at the rear of the first back bracket to support the electric circuit section 170. At this time, it is preferable that the first back bracket 150 and the second back bracket 160 are stuck closely without gap.

In addition, the first and the second back brackets 150 and 160 are formed using steel to enhance their strength. Therefore, even in case that the rear case 180 is damaged, the first and the second back brackets 150 and 160 protect the electric circuit section 170 substantially.

Moreover, the external surface of the electric circuit section 170 is molded by epoxy 173 in a state where the electric circuit section 170 is formed inside the rear case 180. Therefore, it is possible to prevent the external access to the electric circuit section 170.

Hereinafter, the process for protecting the PIN pad module according to the present embodiment will be described.

In case that there is any tampering attempt to remove the bezel base 120 or the button 111 of the key module 100 for the purpose of hacking into a password through the electric circuit section 170 or the key scan board 130 of the PIN pad module, it is required to unscrew the screw of the bezel base 120 or remove the front bracket 114 on which the button 111 is positioned. At this time, the key module 100 protects the front of the PIN pad module.

In case that the screw for fixing the bezel base 120 to the rear case 180 is unscrewed, the pressing force or the location changes at any one of the first rod 122 and the second rod 182 for the second and the third switching portions 126 and 142 of the membrane. Furthermore, the voltage or the electric current changes at any one of the second and third contacts 133 and 134 for the second switching portion 126 and the third switching portion 142. At this time, the electric circuit section 170 recognizes the change in the voltage or the electric current of the second and the third contacts 133 and 134, as hacking for the PIN pad module, thereby making the stored information unreadable.

Figure 10:
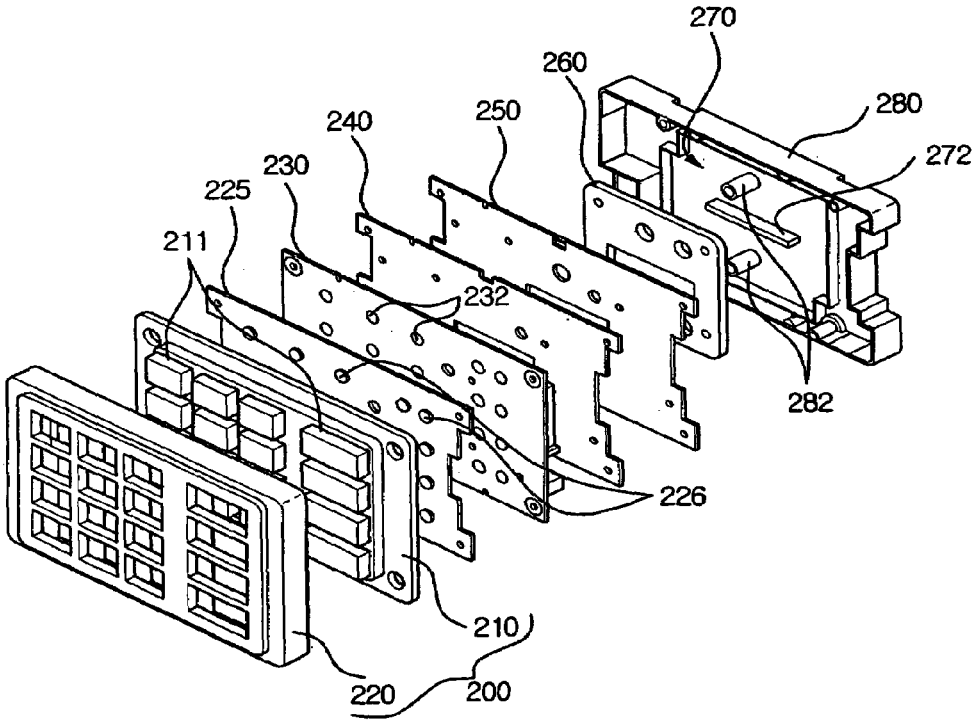
FIG. 10 is a perspective view illustrating an apparatus for protecting a PIN pad module according to one embodiment of the present invention.
Figure 11:
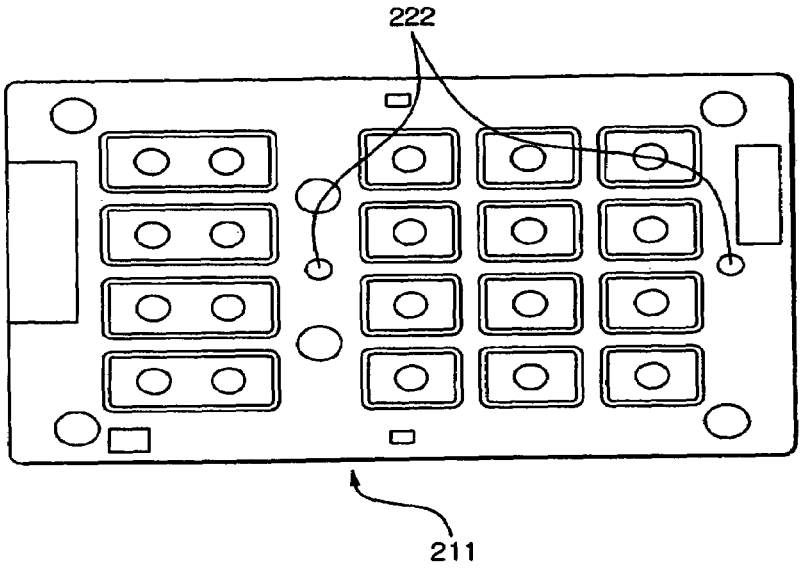
FIG. 11 is a plan view illustrating the rear of a rubber pad including buttons according to one embodiment of the present invention.
Figure 12:
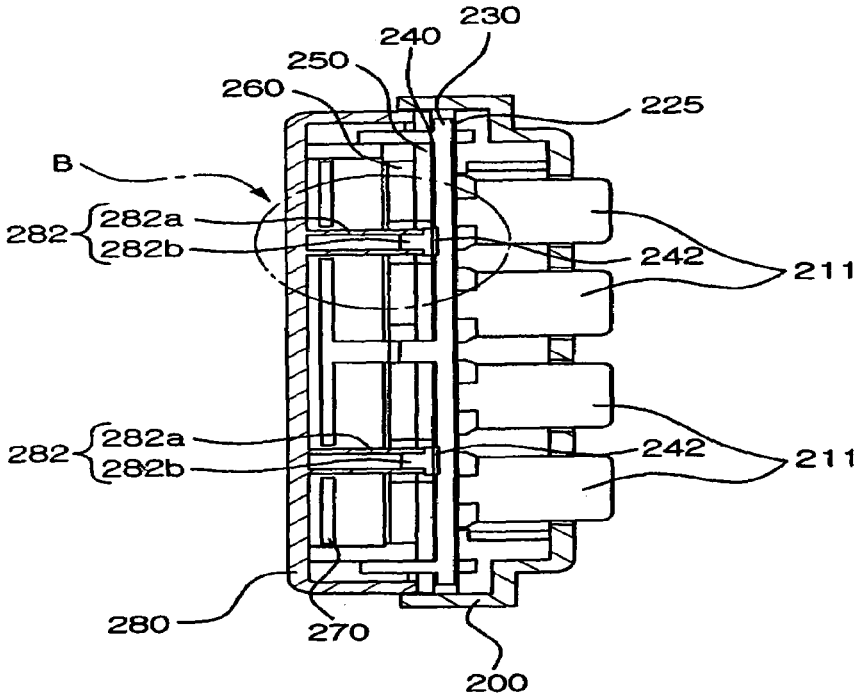
FIG. 12 is a sectional view illustrating an apparatus for protecting a PIN pad module according to one embodiment of the present invention.
Figure 13:
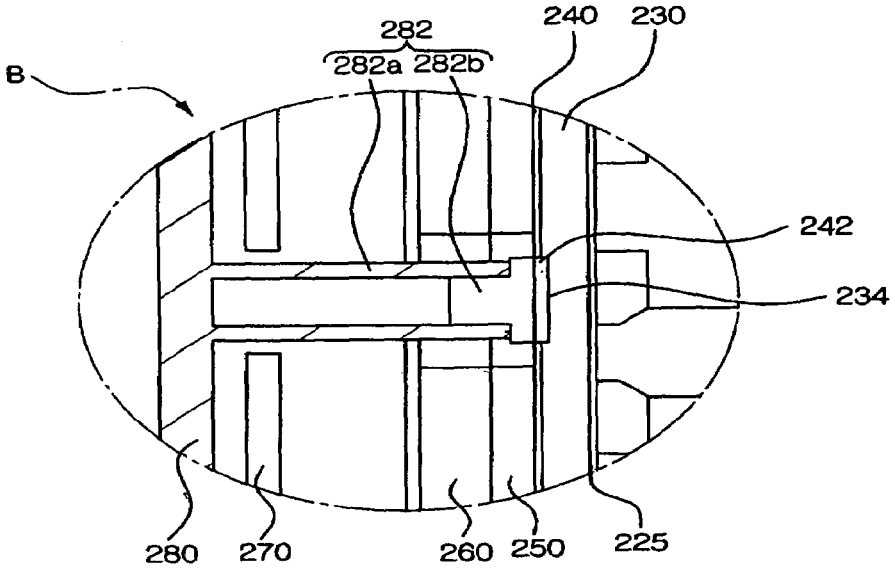
FIG. 13 is a partially enlarged view illustrating a second rod and a third contact of FIG. 12.
Figure 14:
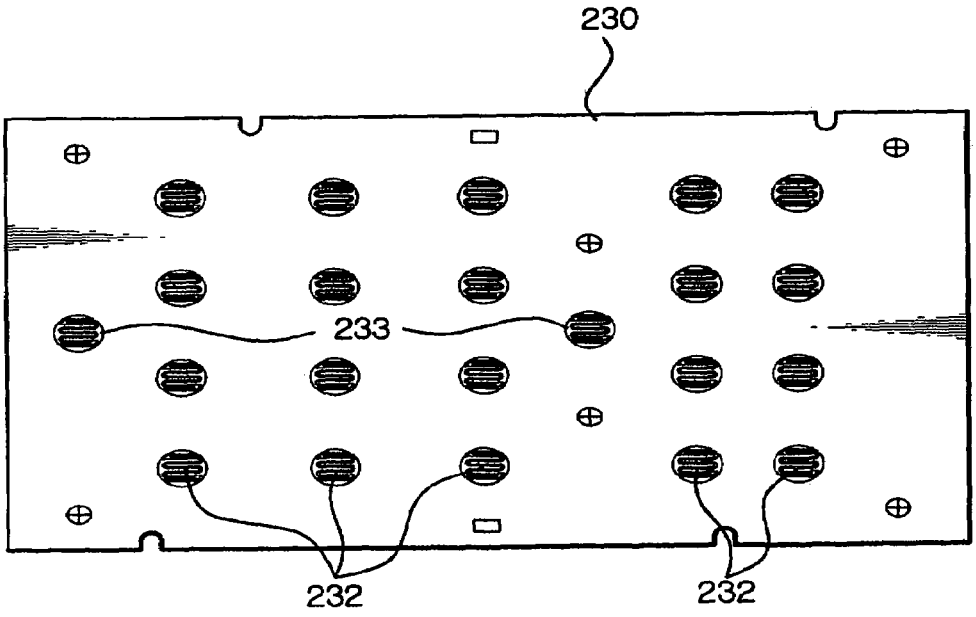
FIG. 14 is a plan view illustrating the upper surface of a key scan board according to one embodiment of the present invention.
Figure 15:
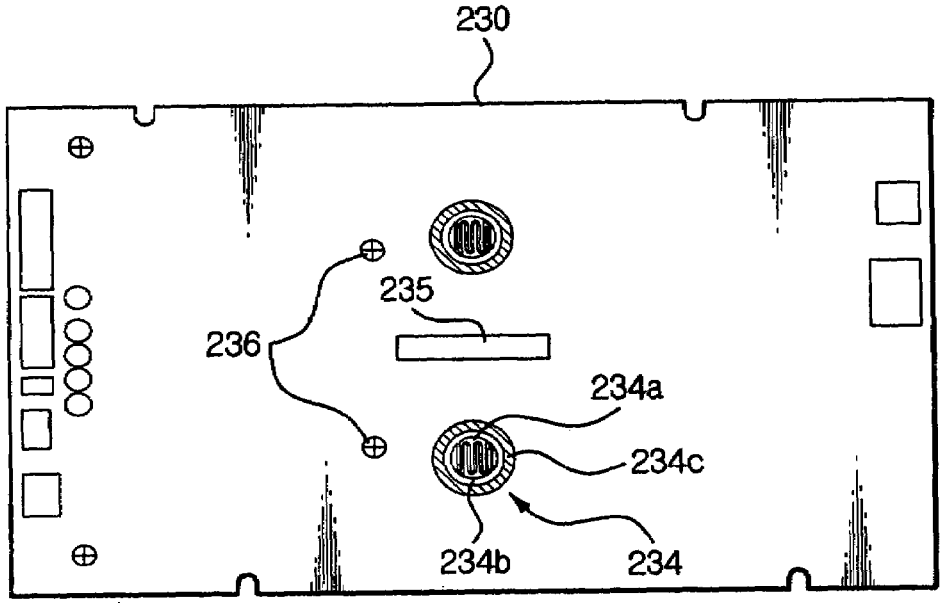
FIG. 15 is a bottom view illustrating the lower surface of a key scan board according to one embodiment of the present invention.
Figure 16:
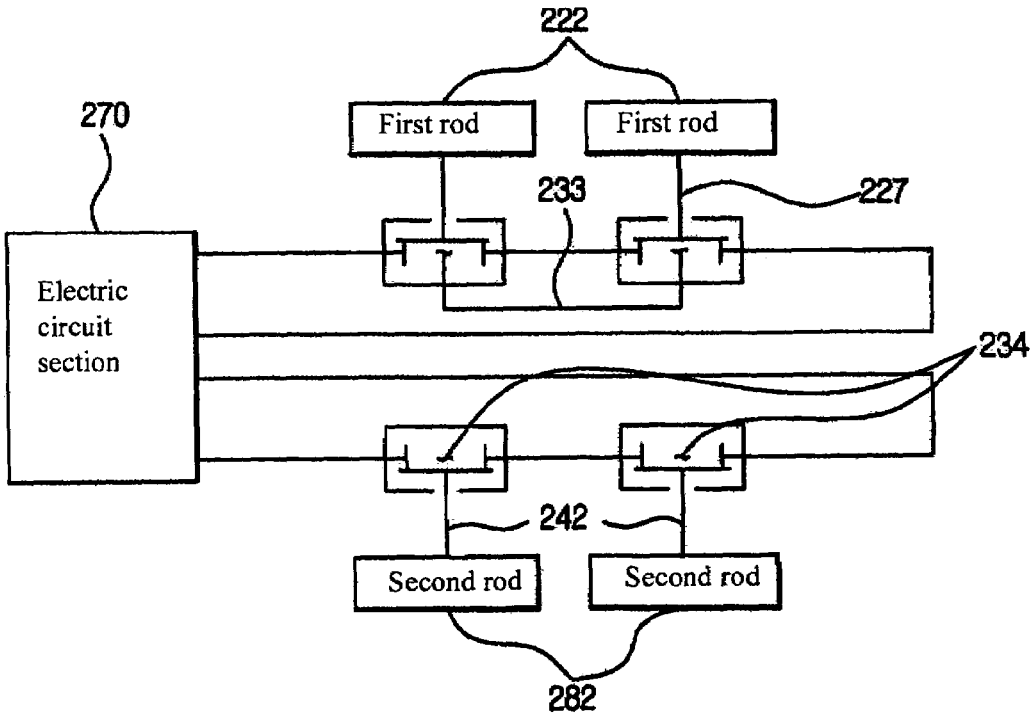
FIG. 16 is a schematic view illustrating a process of protecting a PIN pad module according to one embodiment of the present invention.

FIG. 10 is a perspective view illustrating an apparatus for protecting a PIN pad module according to one embodiment of the present invention; FIG. 11 is a plan view illustrating the rear of a rubber pad including buttons according to one embodiment of the present invention; FIG. 12 is a sectional view illustrating an apparatus for protecting a PIN pad module according to one embodiment of the present invention; FIG. 13 is a partially enlarged view of FIG. 12; FIG. 14 is a view illustrating the upper surface of a key scan board according to one embodiment of the present invention; FIG. 15 is a view illustrating the lower surface of a key scan board according to one embodiment of the present invention; and FIG. 16 is a view illustrating a process of protecting a PIN pad module according to one embodiment of the present invention.

As illustrated, in order to achieve the above object, an apparatus for protecting a PIN pad module according to one embodiment of the present inventions comprises a key module 200 including a rubber pad 210 and a bezel base 220 wherein pluralities of buttons 211 are formed on the front of the rubber pad 210, pluralities of protruded first rods 222 are formed on the rear thereof 210, and the rubber pad 210 is inserted into the bezel base 220 including holes; and a front membrane 225 including a first switching portion 226 for the button 211 of the key module 200 and a second switching portion 227 for the first rod 222, to transmit the pressing force of the button 211 and the first rod 222 to the rear through the first and the second switching portions 226 and 227.

Furthermore, a key scan board 230 is positioned at the rear of the front membrane 225, and includes pluralities of first contacts 232 for the first switching portions 226, and pluralities of second contacts 233 for the second switching portions 227 on the front of the key scan board 230 and pluralities of third contacts 234 on the rear thereof 230. In addition, a rear membrane 240 is positioned at the rear of the key scan board 230, and includes a third switching portion 242 for the third contact 234, and an electric circuit section 270 is positioned at the rear of the rear membrane 240 and includes a memory for receiving the states of connection of contacts of the key scan board 230 to perform logic calculation. A rear case 280 is positioned at the rear of the rear membrane 240, includes a pair of second rods 282 for third contacts 242 and is coupled with the bezel base 220 of the key module 200 by screws.

At this time, the structure and materials of the front membrane 225 and the rear membrane 240 embodying the present embodiment are similar to those of the previous embodiment. The number of the contacts 226 of the front membrane 225 for the buttons 221 formed on the rubber pad 210 and the number of the first contacts 232 of the key scan board 230 is more than that of the previous embodiment.

Furthermore, a circuit connector 272 of the electric circuit section 270 is provided on a vertical line passing through the third contacts 234 and a board connector 235, so that the board connector 235, for transmitting the states of connection at contacts of the key scan board 230, passes through the third contacts 234. The arrangement of the board connector 235 like above is to prevent the board connector 235 from getting access to the third contacts 234 and prevent a hacker from applying electric conduction liquid (electric conduction ink) to the third contact to make it as same as the first state of connection thereof 234. In case that the hacker attempts to put electric conduction liquid into the terminal of the circuit connector 272 in a state where the circuit connector 272 is coupled with the board connector 235, the arrangement of the board connector 235 like above is to prevent an instrument including electric conduction liquid from getting access to the circuit connector 272 by a second rod 282 for the third contact 234.

In addition, the third contact 234 includes a first terminal 234*a* and a second terminal 234*b*, which are electrically connected by the first rod 282, and the third contact 234 further includes a third terminal 234*c* which is formed closely adjacent to the first terminal 234*a* and the second terminal 234*b*, and the electric circuit section 270 makes the stored information unreadable in accordance with the connection between the second and the third terminals 234*a* and 234*b*. Furthermore, although it is not illustrated, the second contact 233 also includes a first terminal and a second terminal which are electrically connected by the first rod 222, just like the third contact 234, and may include a third terminal adjacent to the first terminal or the second terminal.

Meanwhile, the second rod 282 of the rear case 280 is formed to be protruded in the opposite direction from the first rod 222, with the similar structure, and includes a tube portion 282*a* and a rubber member 282*b* for the third contact 242. At this time, the second rods 282 are formed of a pair to correspond to the third contacts 234 and respectively positioned on the upper portion and the lower portion at the center portion of the rear case 280.

Furthermore, a first back bracket 250 is positioned at the rear of the rear membrane 240 to support the rear membrane 240 and the key scan board 230. A second bracket 250 is formed inside the rear case 280 for the electric circuit section 270, and positioned at the rear of the first back bracket 250 to support the electric circuit section 270.

In addition, the first and the second back brackets 250 and 260 are formed using steel to enhance their strength. Therefore, even in case that the rear case 280 is damaged, the first and the second back brackets 250 and 260 protect the electric circuit section 270 substantially.

Moreover, the external surface of the electric circuit section 270 is molded by epoxy in a state where the electric circuit section 270 is formed inside the rear case 280. Therefore, it is possible to prevent the external access to the electric circuit section 270.

The first, the second, and the third contacts 232, 233, and 234 that are formed on the key scan board 230, and a screw hole 236 are positioned similar to the previous embodiment.

Hereinafter, the process for protecting the PIN pad module according to one embodiment will be described.

In case that there is any tampering attempt to remove the bezel base 220 or the button 211 of the key module 200 for the purpose of hacking into a password through the electric circuit section 270 or the key scan board 230 of the PIN pad module, it is required to unscrew the screw of the bezel base 220 or remove the rubber pad 210 on which the button 111 is positioned. At this time, the key module 200 protects the front of the PIN pad module.

In case that the screw for fixing the bezel base 220 to the rear case 280 is unscrewed to remove the bezel base 220 from the rear case 280, or the bezel base 220 is destroyed, thereby moving the rubber pad 210, the pressing force or the location changes at any one of the first rod 222 and the second rod 282 for the second and the third switching portions 226 and 242 of the membrane. Furthermore, the voltage or the electric current changes at any one of the second and third contacts 233 and 234 for the second switching portion 226 and the third switching portion 242. At this time, the electric circuit section 270 recognizes the change as hacking for the PIN pad module, thereby making the stored information unreadable.

As described above, in case that an apparatus for protecting a PIN pad module according to the present invention is adopted and there is any tampering attempt to physically disassemble the PIN pad module to install hacking equipments for the purpose of finding out a password, the pressing force or location changes at any one of the first and the second rods, wherein the PIN pad module is installed in a financial terminal or the like. In addition, the voltage or electric current changes at any one of the second and the third contacts of the key scan board and the electric circuit section detects the event and recognizes the event as hacking for the PIN pad module, thereby making the stored information unreadable. Therefore, the present invention can enhance the security of the PIN pad module.

Furthermore, the rear of the key scan board embodying the PIN pad module is protected by a plurality of metal brackets. Therefore, the present invention can prevent a hacker's intrusion, such as for example, cutting off the rear of the PIN pad module and accessing the key scan board.

Furthermore, a method of detecting hacking that is adopted by the apparatus for protecting the PIN pad module, does not electrically connect contacts by fixing components. The method uses contacts of the key scan board in which the electric circuit section detects the states of connection. Therefore, in case that an intruder cuts off around the fixing component or cuts off the fixing component, the pressing force or the location of the rod changes at contacts and the electrical change occurs at contacts. Thus, the present invention can detect the intrusion immediately through the electric circuit section.

What is claimed is:

1. A tamper resistant PIN entry apparatus comprising:

a key module including a button provided substantially on the front of the key module and a first rod formed substantially on the rear of the key module;

a key scan board including a first contact for the button, a second contact for the first rod and a third contact, wherein the first and the second contacts are formed substantially on the front of the key scan board and the third contact is formed substantially on the rear of the key scan board;

a rear case coupled with the key module, including a second rod for the third contact; and an electric circuit section for making a stored information unreadable in accordance with a change of an electric current or voltage at the second contact or the third contact, the change caused by reduction or absence of pressing force by the first rod or the second rod.

2. The apparatus as claimed in claim 1, further comprising a metal plate mounted adjacent to the key module or the rear case to physically protect the key scan board against a tampering attempt.

3. The apparatus as claimed in claim 1, wherein the first rod or the second rod includes a tube portion and a rubber member, the tube portion is protruded on the key module or the rear case toward the second contact or the third contact, and the rubber member is positioned at the end of the tube portion to elastically press the second or the third contact, respectively.

4. The apparatus as claimed in claim 1, wherein a circuit connector is formed on the electric circuit section, a board connector is formed on the key scan board in accordance with the circuit connector, the board connector is electrically connected to the circuit connector to transmit the states of connection at the first, the second and the third contacts to the electric circuit.

5. The apparatus as claimed in claim 1, wherein the second and the third contacts are formed using piezo electric elements to measure the pressing force.

6. The apparatus as claimed in claim 1, wherein at least one of the second and the third contact is positioned adjacent to a screw hole for coupling the key module and the rear case.

7. The apparatus as claimed in claim 1, wherein a screw hole for coupling the key module and the rear case is formed at the center portion of the key scan board, and the second contact is positioned adjacent to the screw hole on the key scan board.

8. The apparatus as claimed in claim 1, wherein the third contact is positioned substantially on a vertical line passing the center portion of the rear of the key scan board.

9. The apparatus as claimed in claim 1, wherein the second contact or the third contact includes a first terminal and a second terminal, the first terminal and the second terminal are electrically connected by the first rod or the second rod, the second contact or the third contact further includes a third terminal is formed closely adjacent to the first and the second terminal to form a part of the electric circuit section, and the electric circuit section makes the stored information unreadable in accordance with the connection between the first and the third terminals or between the second and the third terminals.

10. The apparatus as claimed in claim 9, wherein the third terminal is formed in a shape of a ring around the first terminal and the second terminal.

11. The apparatus as claimed in claim 1, further comprising a front membrane interposed between the key module and the key scan board, wherein the front membrane includes a first switching portion for electrically connecting or cutting off the first contact according to the button of the key module and a second switching portion for electrically connecting or cuffing off the second contact according to the first rod.

12. The apparatus as claimed in claim 1, further comprising a rear membrane interposed between the key scan board and the rear case, wherein the rear membrane includes a third switching portion for electrically connecting or cuffing off the third contact according to the second rod.

13. The apparatus as claimed in claim 1, further comprising a back bracket interposed between the key scan board and the electric circuit section to stably support the key scan board and the electric circuit section.

14. The apparatus as claimed in claim 13, wherein the back bracket is formed using a pile of metal plates.

15. The apparatus as claimed in claim 1, wherein the key module further includes, a protection rubber attached on the rear portion of the button for water-proofing;

a front bracket positioned substantially at the front of the button, having a button hole regularly arranged in the front bracket;

a protection pad positioned substantially at the rear of the front bracket, wherein the protection rubber is stuck to the protection pad for water-proofing;

a transmitting member positioned substantially at the rear of the protection pad, for transmitting a pressing force given to the button;

a switching member positioned substantially at the rear of the transmitting member, for transmitting a pressing force given to the transmitting member; and a bezel base including a groove formed substantially on the front of the bezel base for receiving the transmitting member, a hole formed at the groove for passing the switching member and the first rod protruded backward at the rear of the bezel base to press the second contact.

16. The apparatus as claimed in claim 1, wherein the key module further includes, a rubber pad including the button protruded forward substantially at the front of the rubber pad and the first rod protruded backward substantially at the rear of the rubber pad; and a bezel base positioned at the front of the rubber pad, including a hole for exposing the button.

* * * * *